US008860628B2

(12) United States Patent
Cathelin et al.

(10) Patent No.: US 8,860,628 B2
(45) Date of Patent: Oct. 14, 2014

(54) ANTENNA ARRAY FOR TRANSMISSION/RECEPTION DEVICE FOR SIGNALS WITH A WAVELENGTH OF THE MICROWAVE, MILLIMETER OR TERAHERTZ TYPE

(75) Inventors: Andreia Cathelin, Laval (FR); Mathieu Egot, Grenoble (FR); Romain Pilard, Goncelin (FR); Daniel Gloria, Detrier (FR)

(73) Assignees: STMicroelectronics SA, Montrouge (FR); STMicroelectronics (Crolles 2) SAS, Crolles (FR)

( * ) Notice: Subject to any disclaimer, the term of this patent is extended or adjusted under 35 U.S.C. 154(b) by 334 days.

(21) Appl. No.: 13/242,591

(22) Filed: Sep. 23, 2011

(65) Prior Publication Data

US 2012/0086608 A1 Apr. 12, 2012

(30) Foreign Application Priority Data

Oct. 6, 2010 (FR) ..... 10 58110

(51) Int. Cl.

| | |
|---|---|
| ***H01Q 21/00*** | (2006.01) |
| ***H01Q 3/34*** | (2006.01) |
| ***H01Q 3/24*** | (2006.01) |
| ***H01Q 21/06*** | (2006.01) |
| ***H01Q 21/29*** | (2006.01) |

(52) U.S. Cl.

CPC ..... *H01Q 21/061* (2013.01); *H01Q 3/34* (2013.01); *H01Q 3/24* (2013.01); *H01Q 21/293* (2013.01)

USPC ..... 343/893; 343/853

(58) Field of Classification Search

USPC ..... 343/700 MS, 893, 853

See application file for complete search history.

(56) References Cited

U.S. PATENT DOCUMENTS

| | | | | |
|---|---|---|---|---|
| 2,515,344 | A * | 7/1950 | Guanella et al. | 342/386 |
| 4,414,550 | A * | 11/1983 | Tresselt | 343/700 MS |
| 6,369,770 | B1 * | 4/2002 | Gothard et al. | 343/794 |
| 6,724,346 | B2 * | 4/2004 | Le Bolzer et al. | 343/700 MS |
| 7,623,868 | B2 * | 11/2009 | Judd et al. | 455/448 |
| 2008/0303718 | A1 * | 12/2008 | Chiang et al. | 342/373 |

OTHER PUBLICATIONS

Alhalabi, R.A., et al., "High-Gain Yagi-Uda Antennas for Millimeter-Wave Switched-Beam Systems," IEEE Transactions on Antennas and Propagation, vol. 57, No. 11, Nov. 2009, pp. 3672-3676.

Lantéri, J., et al., "60 GHz Antennas in HTCC and Glass Technology," Proceedings of the Fourth European Conference on Antennas and Propagation (EuCAP), Apr. 2010, pp. 1-4.

Zhang, Y.P., et al., "On-Chip Antennas for 60-GHz Radios in Silicon Technology," IEEE Transactions on Electron Devices, vol. 52, No. 7, Jul. 2005, pp. 1664-1668.

* cited by examiner

*Primary Examiner* — Dieu H Duong

(74) *Attorney, Agent, or Firm* — Slater & Matsil, L.L.P.

(57) ABSTRACT

Transmission/reception device for signals having a wavelength of the microwaves, millimeter or terahertz type, comprising an antenna array. The antenna array comprises a first group of first omni-directional antennas and a second group of second directional antennas disposed around the first group of antennas.

27 Claims, 8 Drawing Sheets

ANTENNA ARRAY FOR TRANSMISSION/RECEPTION DEVICE FOR SIGNALS WITH A WAVELENGTH OF THE MICROWAVE, MILLIMETER OR TERAHERTZ TYPE

CROSS REFERENCE TO RELATED APPLICATION

This application claims the priority benefit of French Patent Application Number 10-58110, filed Oct. 6, 2010, entitled "Antenna array for transmission/reception device for signals with a wavelength of the microwave, millimeter or terahertz type," which is hereby incorporated by reference to the maximum extent allowable by law.

TECHNICAL FIELD

The invention relates to the transmission of signals with a wavelength of the microwave, millimeter and terahertz type whose frequencies go respectively from 300 MHz to 30 GHz, from 30 GHz to 300 GHZ and from 300 GHz to 3 THz and, more particularly, to antennas adapted to such transmissions.

BACKGROUND

The invention may advantageously be applied, but is not limited to, wireless electronic systems capable of exchanging such signals with microwaves, millimeter and terahertz wavelengths.

The HDMI standard is a wired video data transmission standard. The data rates are very high. In order to obtain such a wireless transmission (W-HDMI), the use of a 60 GHz frequency is proposed with a very high data rate (between 3 and 6 Gb/s) and over distances from 3 to 10 meters between two transmitters/receivers for which the nature of the path of the waves between these two elements can be direct (LOS or Line-of-Sight) or indirect (NLOS or Non-Line-of-Sight) using the acronyms that are well known to those skilled in the art. An antenna or an antenna array must then be used whose radiation pattern in transmission and reception is steerable and a system is needed with a high wireless transmission gain (or "air link gain" according to a term well known to those skilled in the art).

There are then two possible alternatives for the implementation of this system. A first alternative aims to use a power amplifier with a high output power connected to an antenna or antenna array having a moderate gain. This then leads to a high power consumption. Another alternative aims to use a power amplifier with a moderate output power connected to an antenna or antenna array having a high gain. This then leads to a reduced power consumption of the system but the antenna or the antenna array generally requires additional external devices (for example a lens) in order to achieve a high gain.

With an antenna array, it is possible to obtain an electronic pointing of the array in one direction by varying the phase and the amplitude of each of the signals sent to and/or received from the antennas of the array. Indeed, depending on the various phase shifts, the direction of the radiation pattern of the antenna array can be adjusted. Moreover, in a given direction, a higher gain can be obtained than with a single omnidirectional antenna.

For the elements of the antenna array, planar antennas or non-planar antennas may be used. The literature provides exemplary embodiments of antennas.

Thus, the publication entitled "High-Gain Yagi-Uda Antennas for Milimeter-Wave Switched-Beam Systems", by Ramadan A. Alhalabi and Gabriel M. Rebeiz in IEEE TRANSACTIONS ON ANTENNA AND PROPAGATION, VOL. 57, NO. 11, NOVEMBER 2009, describes a high-efficiency power supply for an antenna known as a Yagi Uda antenna for millimeter wavelengths using a microstrip system. This antenna is constructed on either side of a teflon substrate which allows the passage from a symmetric transmission line (antenna) to an asymmetric transmission line (microstrip). A gain of 9-11 dB is thus obtained for frequencies in the range 22-26 GHz. When used in an array of two antennas, a gain of 11.5-13 dB is obtained for the frequencies 22-25 GHz. A high radiation efficiency is obtained.

The publication entitled "On-Chip Antennas for 60-GHz Radios in Silicon Technology" by Y. P. Zhang, M. Sun, and L. H. Guo in IEEE TRANSACTIONS ON ELECTRON DEVICES, VOL. 52, NO. 7, JULY 2005, describes a compact and efficient antenna for 60 GHz radio waves. This antenna is fabricated on a silicon substrate with a low resistivity of 10 Ω·cm. Two types of antennas have been used, namely an antenna of the Yagi-Uda type and an antenna referred to as an inverted-F antenna. The results obtained are respectively the following: for the inverted-F antenna, insertion losses of 32 dB and a gain of −19 dBi at 61 GHz, and for the Yagi-Uda antenna, insertion losses of 6.75 dB and a gain of −12.5 dBi at 65 GHz (with dBi a unit well known to those skilled in the art representing in dB the gain of an antenna with respect to an isotropic aerial, in other words an antenna which is capable of radiating or of also receiving in every direction and for every polarization).

The publication entitled "60 GHz Antennas in HTCC and Glass Technology" by J. Lanteri, L. Dussopt, R. Pilard, D. Gloria, S. Yamamoto, A. Cathelin, H. Hezzeddine from EuCAP 2010, describes an antenna constructed on glass and connected to a ceramic module using the 'flip-chip' technique. An antenna array comprising two antennas such as described hereinabove has also been fabricated. The results obtained are the following: for the single antenna, insertion losses less than 10 dB and a gain of 6-7 dBi over a bandwidth at −10 dB of 7 GHz and, for the antenna array, a gain of 7-8 dBi over a bandwidth at −10 dB of 3 GHz.

When an antenna array using a single type of antenna is employed, for example antennas of the planar type, the radiation pattern of the array can be degraded for large pointing angles with respect to the normal to the plane formed by the antenna array. This is notably the case when the electronically pointed directions make a large angle θ(theta) in the plane of the electric field with the normal to the plane of the antenna, in the radiating direction.

FIGS. 1 to 3 illustrate this problem in the particular case of planar antenna arrays. FIG. 1 shows an antenna array RE comprising 4 planar antennas E1, E2, E3, E4 having the same orientation and the same radiation pattern. The distance between the barycentres of E1 and E3 is equal to the distance between the barycentres of E2 and E4 and the distance between the barycentres of E1 and E2 is equal to the distance between the barycentres of E3 and E4. Accordingly, the antenna array is one in which the barycentres of the antennas are mutually equidistant, and typically separated by $\lambda_0/2$, $\lambda_0$ being the wavelength in air of the signal to be transmitted or received.

The planar antennas E1, E2, E3, E4 are identical and a more detailed representation is shown at the bottom of FIG. 1. In fact, a planar antenna is for example formed from a substrate SB represented by the large parallelepiped onto which a conducting surface SC, represented by the small rectangle on the surface, is bonded or connected.

FIGS. 2 and 3 show radiation patterns as a function of the orientation of the electromagnetic waves to the normal to the planar antennas in the plane of the electric field, for the antenna array according to FIG. 1. For the sake of clarity, the 7 curves shown have been distributed between FIG. 2 (C1, C2, C3, C4, C5) and FIG. 3 (C6, C7).

The curve C1 represents the radiation pattern of one of the elements E1, E2, E3 or E4 as a function of the orientation of the electromagnetic waves to the normal from the elements E1, E2, E3 or E4.

The curve C2 represents the theoretical radiation pattern for the antenna array as a function of the orientation of the electromagnetic waves in the plane of the electric field. This pattern is determined by adding to the curve C1 the value: "10 log (N)" for N elements, in other words 10 log (4) with 4 elements E1 . . . E4. The notation log represents the logarithmic function in base 10.

Each of the curves C3, C4, C5, C6 and C7 illustrates, for a pointing direction making an angle θ (theta) with the normal to the antenna array RE in the plane of the electric field, the radiation pattern as a function of the orientation of the electromagnetic waves. The pointing direction is obtained electronically by applying various phase shifts to each of the signals from the elements E1 . . . E4.

The curve C3 corresponds to the case where no phase shift is applied to the antenna array. In this case, the maximum directivity of the radiation pattern is aligned with the direction normal to the planar antennas. The pointing direction makes an angle θ(theta) equal to 0 with the normal to the antenna array, in other words the pointing direction is in the same direction as the normal to the antenna array, this direction is also known as "azimuth".

The curve C4 corresponds to the pointing direction making an angle θ (theta) equal to +35° in the plane of the electric field with the normal to the antenna array.

The curve C5 corresponds to the pointing direction making an angle θ(theta) equal to +70° in the plane of the electric field with the normal to the antenna array.

The curve C6 corresponds to the pointing direction making an angle θ(theta) equal to +80° in the plane of the electric field with the normal to the antenna array.

The curve C7 corresponds to the pointing direction making an angle θ(theta) equal to +90° in the plane of the electric field with the normal to the antenna array.

As can be seen, the pattern represented by the curve C3 comprises two side lobes for the orientations "+50°" and "−50°". These are substantially reduced with respect to the main lobe) (0°).

The pattern represented by the curve C4 comprises a main lobe (+35°) and three side lobes at around the orientations "−10°", "−45°" and "−85°". These are also relatively substantially reduced.

The pattern represented by the curve C5 comprises a main lobe (+70°) and three side lobes around the orientations "+10°", "−20°" and "−70°". As can be seen, the side lobe along the orientation "−70°" has almost the same gain as the main lobe.

The pattern represented by the curve C6 comprises a main lobe (70°) with three side lobes at around the orientations "15°", "−15°" and "−70°". The side lobe along the orientation "−70°" has a gain equal to the main lobe. Moreover, the main lobe is not in the pointing direction but along an orientation making a smaller angle (+70°).

The pattern represented by the curve C7 comprises a main lobe (+70°) and three side lobes around the orientations "+10°", "−20°" and "−70°". The side lobe along the orientation "−70°" also has a gain equal to the main lobe. Moreover, the main lobe is not in the pointing direction θ(theta) equal to +90° but in a direction making a smaller angle (+70°).

The following are thus observed for electronically pointed directions making large angles θ(theta) with the normal:

a superposition of the main lobes for pointing directions making angles θ(theta) greater than 70°, a degradation of the main lobe for pointing angles θ(theta) greater than 45°, a generation of side lobes with a gain as high as the main lobes for pointing angles θ(theta) greater than 45°.

Several problems can then result: degradation of the aerial transmission gain in the lateral directions, problems of synchronization between the transmitter and the receiver, direction of the transmission not well defined, generation of several paths (due to the side lobes) and appearance of interference effects.

Several conventional techniques exist for reducing (or "tapering" according to a term well known to those skilled in the art), the side lobes in the case of an antenna array.

One of the known techniques ("amplitude tapering" according to a term well known to those skilled in the art) consists in adjusting the amplitude of the signals from each of the antennas. This solution can thus be implemented by an electronic management system. However, it is difficult to control the relative amplitude of each antenna for the numerous orientations of the waves to be transmitted and/or received.

Another solution consists in adjusting the phase of the signals from each of the antennas ("phase tapering" according to a term well known to those skilled in the art). This solution can also be implemented by an electronic management system, but it is very complex to control and may even be incompatible with the pointing techniques using the phase.

Another technique consists in spacing the various antenna elements by non-uniform distances, but the antenna array obtained could then get very large.

SUMMARY OF THE INVENTION

According to one aspect, a transmission/reception device for signals having a microwave, millimeter, or terahertz wavelength comprising an antenna array including a first group of first omni-directional antennas and a second group of second directional antennas disposed around the first group of antennas.

BRIEF DESCRIPTION OF THE DRAWINGS

Other features and advantages of the invention will become apparent upon examining the detailed description of non-limiting embodiments and their implementations, and the appended drawings in which.

DETAILED DESCRIPTION OF ILLUSTRATIVE EMBODIMENTS

Figure 1:
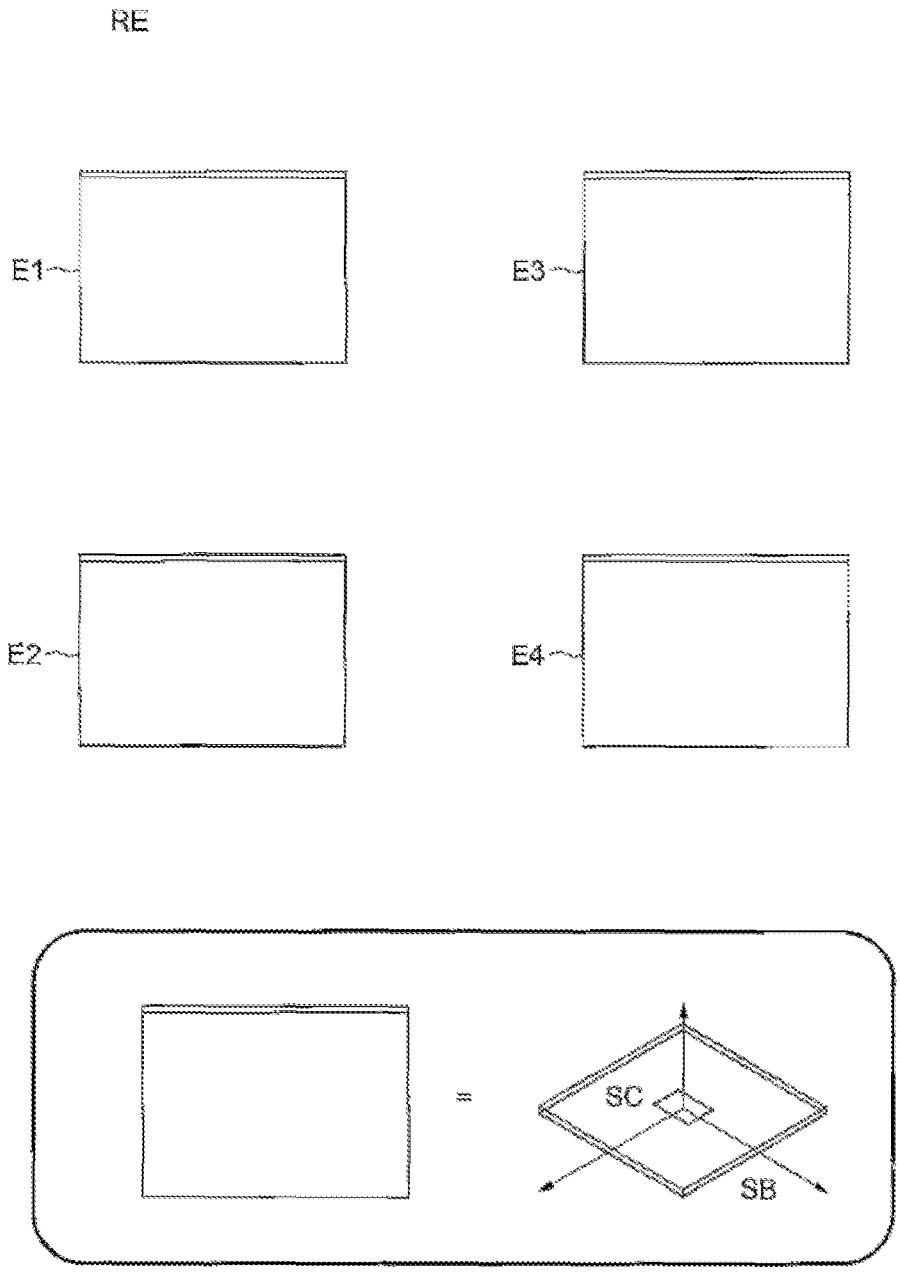
FIG.1 PRIOR ART
FIGS. 1 to 3, already described, illustrate schematically an example of an antenna array according to the prior art and of associated radiation patterns.

Before addressing the illustrated embodiments in detail, various embodiments and advantageous features thereof will be discussed generally. According to one embodiment, a device is provided that is compatible with an HDMI wireless application, aiming to minimize or to overcome the aforementioned drawbacks while at the same time maintaining an antenna array with reduced size and a system having a reasonable power consumption.

According to one embodiment, such a transmission and reception device is provided whose radiation pattern is not degraded for directions making angles θ of more than 45° in the plane of the electric field. According to another embodiment, such a transmission and reception device is also provided in which the side lobes of the radiation pattern are weak.

According to one aspect, a transmission/reception device for signals having a microwave, millimeter, or terahertz wavelength comprising an antenna array. According to one general feature of this aspect, the antenna array comprises a first group of first omni-directional antennas and a second group of second directional antennas disposed around the first group of antennas.

The pointing with phase-shift does not always allow a satisfactory radiation pattern to be obtained and the use of directional antennas can thus complete the radiation of the omni-directional antennas.

The angle θ between the normal to a first antenna and the maximum directivity of the radiation from a second antenna is preferably high which allows a global radiation pattern of the antenna array to be obtained that is much less degraded than in the prior art, or even not degraded at all.

Thus, according to one embodiment, the angle between the normal to each first antenna and the maximum directivity of the radiation pattern of each second antenna is in the range between 45° and 90°.

The maximum directivity of the radiation pattern along these directions allows the radiation pattern of the first group of the first antennas, which is degraded for pointing directions making an angle greater than 45° with the normal, to be completed. The resulting radiation pattern therefore enables the transmission and the reception of waves having an orientation greater than 45° to the normal.

According to one embodiment, the first group of first antennas is situated in an ovoid-shaped central region and comprises identical first antennas, whose isobarycentres are mutually equidistant. The use of an ovoid shape allows an efficient distribution of the antennas. Furthermore, if the antenna array is centroidal, a radiation pattern having a center of symmetry is obtained. In addition, the use of uniform distances between the isobarycentres of the antennas allows the surface of the antenna array to be minimized for the same antenna gain.

According to one embodiment, the isobarycentres of the first antennas are mutually equidistant by a distance equal to half the wavelength of the signals. According to one embodiment, the isobarycentres of the second antennas are also mutually equidistant. According to one embodiment, the isobarycentres of the first and second antennas are mutually equidistant.

According to one embodiment, the first antennas of the first group all have the same orientation, in other words the same omni-directional radiation pattern. The fabrication of the antenna array is then simpler.

According to one embodiment, the second group of antennas is situated in a ring around the central region and comprises second identical antennas, the maximum directivity of the radiation pattern of each second antenna being oriented towards the outside of the ring with respect to the central region.

According to one embodiment, the maximum directivity of the radiation pattern of each second antenna is oriented along a radius of the said ring. The use of a radiation pattern in the direction of the radius of the ring around the ovoid region allows optimum distribution of the various directions in which the directional antennas point.

According to one embodiment, the device also comprises control means capable of controlling means configured for selectively disabling at least one second antenna and its active part.

A part of the directional antennas is not useful when the direction of the wave to be transmitted or received does not correspond to their radiation pattern. It is therefore advantageous to be able to disable some of these directional antennas and the active elements of the circuit connected to these antennas in order to reduce the power consumption.

According to one embodiment, the control means are furthermore capable of controlling phase-shifting means configured for applying phase-shifts to the signals from the antennas of the first group and/or to the signals from the antennas of the second group. The maximum directivity of the radiation pattern of the antenna array is therefore adjustable.

According to one embodiment, the signals are situated in a band of frequencies around 60 GHz.

According to another aspect, a wireless communications device is provided, comprising a transmission/reception device such as described hereinabove.

Figure 4:
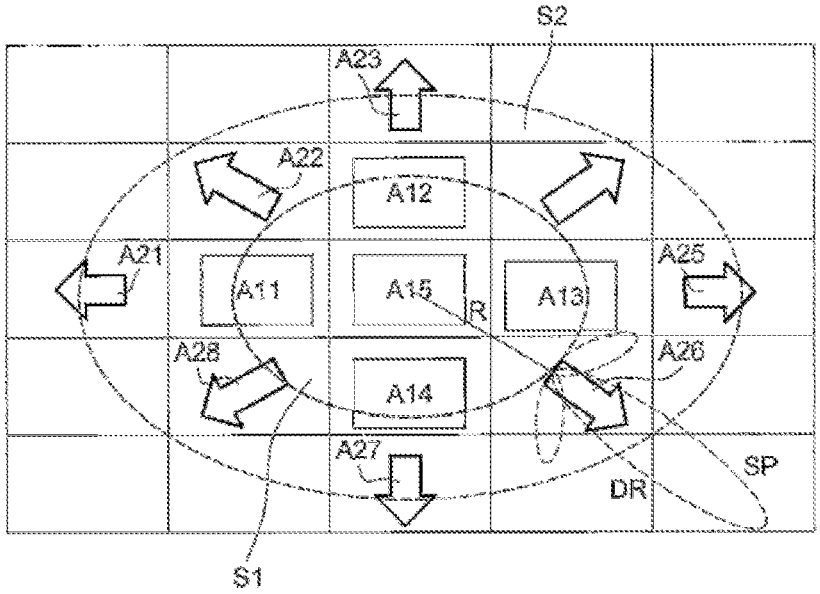
FIG. 4 illustrates an embodiment of an antenna array according to the invention.
Figure 4:
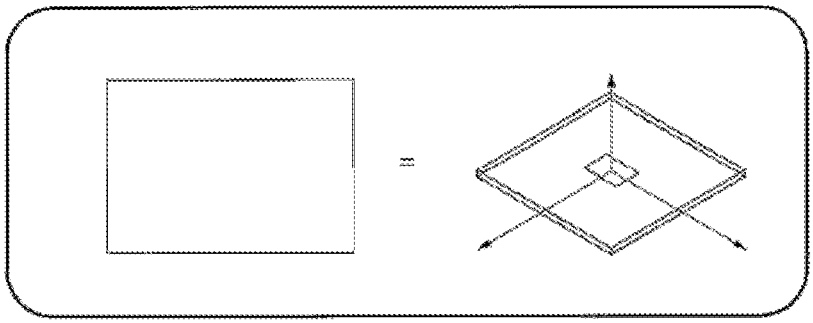
Figure 4:
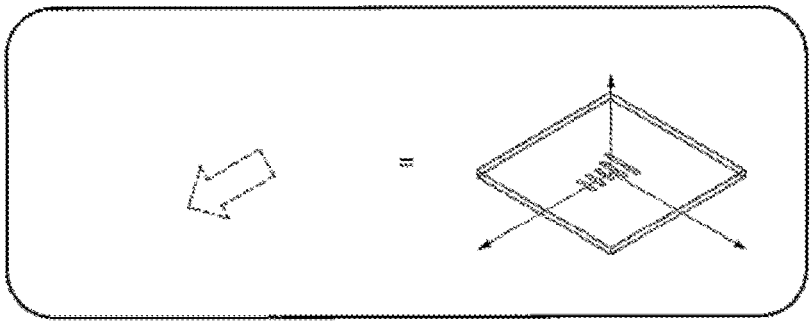

Turning now to the specific illustrated embodiments, FIG. 4 shows schematically an exemplary arrangement of an antenna array seen from above. This array here comprises 13 antennas, namely a first group of first antennas A11, A12, A13, A14, A15 which are omni-directional and a second group of second antennas A21, A22, A23, A24, A25, A26, A27, A28 which are directional. The omni-directional antennas are situated in a central region of ovoid shape S1. They all have the same orientation and are all identical.

In this non-limiting example, the array is substantially planar and centroidal.

The directional antennas, which are all identical, are disposed around the omni-directional antennas, more precisely in a ring S2 around the central region S1.

Each of the antennas is represented schematically by a rectangle in the case of an omni-directional antenna and by an arrow in the case of a directional antenna. As can be seen at the bottom of FIG. 4, each of the directional antennas may (in a non-limiting manner) take the form of an antenna of the Yagi-Uda type which is well known to those skilled in the art. By way of exemplary embodiment, the omni-directional antennas are planar antennas (bottom of FIG. 4).

The grid-lines illustrated in FIG. 4 highlights the fact that the isobarycentres of each of the directional or omni-directional antennas are mutually equidistant. Advantageously, the spacing between the isobarycentres in width and in length may be chosen as a distance equal to half the wavelength of the carrier signal SP (FIG. 5) to be transmitted or received.

Figure 2:
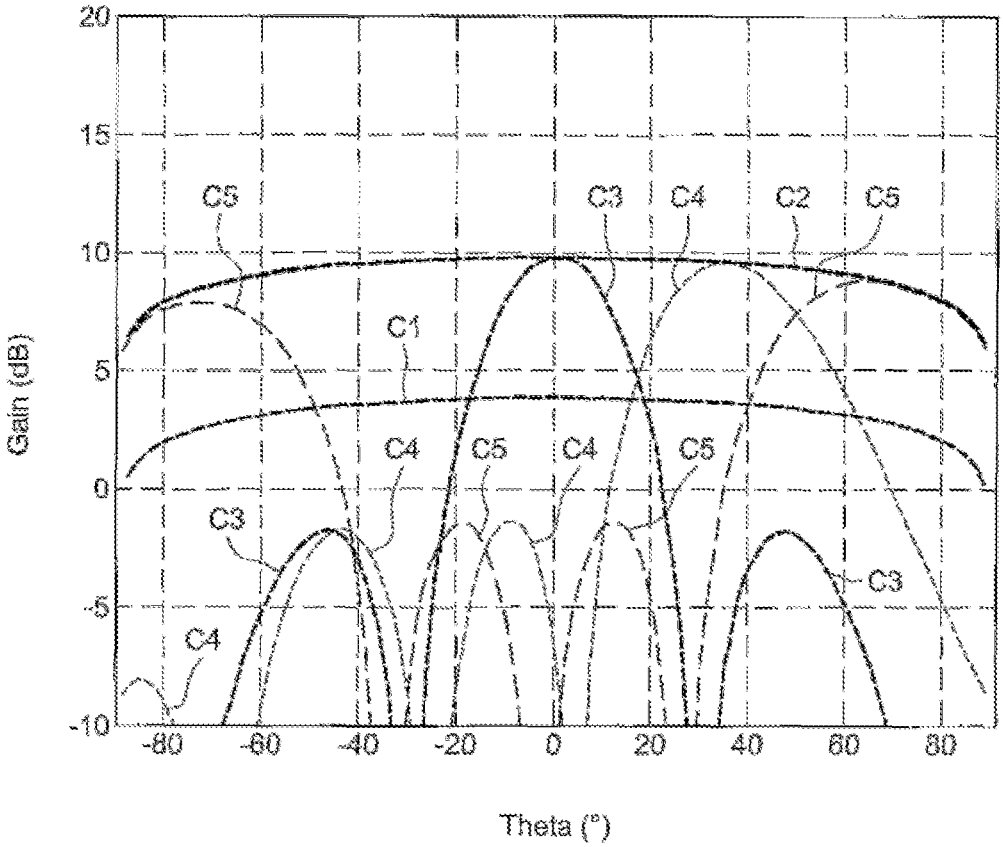
FIG.2 PRIOR ART
Figure 3:
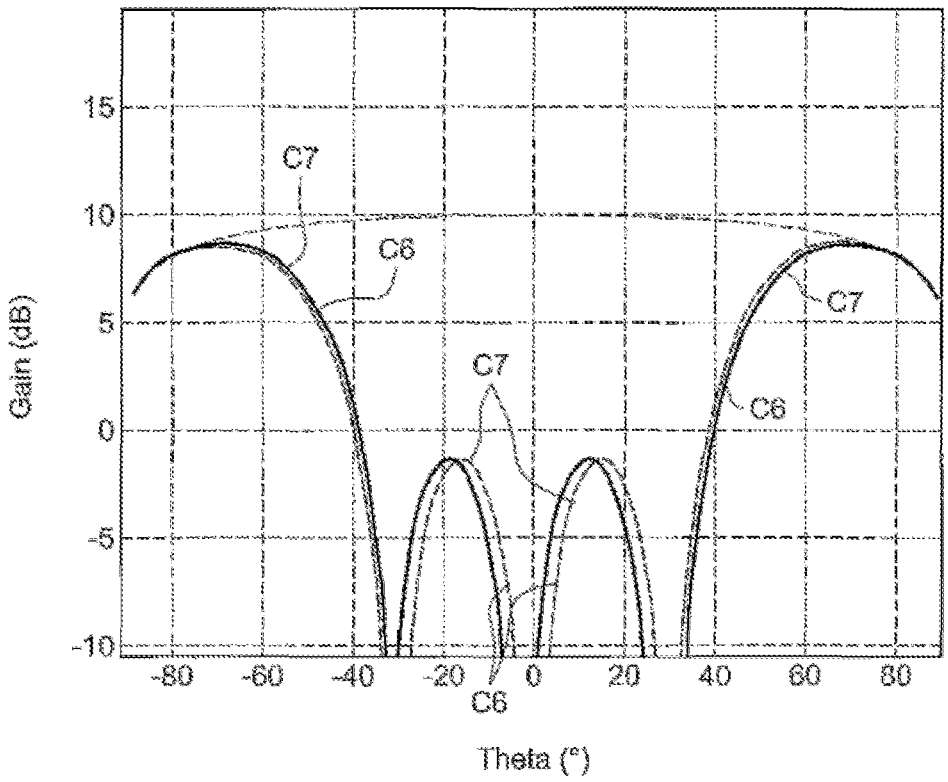
FIG.3 PRIOR ART

The radiation pattern of the first group of first antennas A11-A15 is similar to that which was illustrated for 4 planar antennas in FIGS. 1, 2, 3. In other words, for an electronically pointing direction making a large angle θ(theta) (typically greater than 45°) with the normal to the first antennas, the radiation pattern of the first group of antennas A11-A15 is degraded. However, this is compensated by the antennas A21-A28 of the second group as will be seen hereinafter.

The radiation pattern of the directional antennas is represented by the arrow which also indicates the maximum directivity of the radiation pattern. As can be seen, for the antenna A26, this direction is preferably oriented along a radius R of the ring. The maximum directivity of the radiation pattern (DR) of the second antennas, in this example, lies in a plane that is slightly inclined with respect to the plane of the antenna array, in other words the angle θ(theta) between the normal to the planar antennas and the maximum directivity of the radiation pattern DR is about 90°. However, this value is non-limiting and the angle between the normal and the maximum directivity can be situated in the range 45°-90°. In addition, the pattern DR of each of the directional antennas comprises for example a first main lobe and two side lobes having a lower gain.

In other words, a second group of antennas is used that comprises directional antennas whose maximum directivity of the radiation pattern without phase-shift points in directions making a large angle, for example in the range between 45° and 90°, with the normal to the first group of antennas. Thus, pointing in these directions with the first group of antennas is no longer necessary and the drawbacks that have been mentioned relating to a group of planar antennas pointing in these directions are eliminated. The first planar antennas continue to point electronically in the directions that may entail no degradation of the radiation pattern. An array with an electronically steerable radiation pattern is thus obtained which is completed for the extreme orientations by the directional antennas.

Furthermore, by using directional antennas whose maximum directivity of the radiation pattern without phase-shift points in directions oriented along radii, all the orientations can be reached and a hemispherical radiation pattern is approximated for the whole antenna array.

Figure 5:
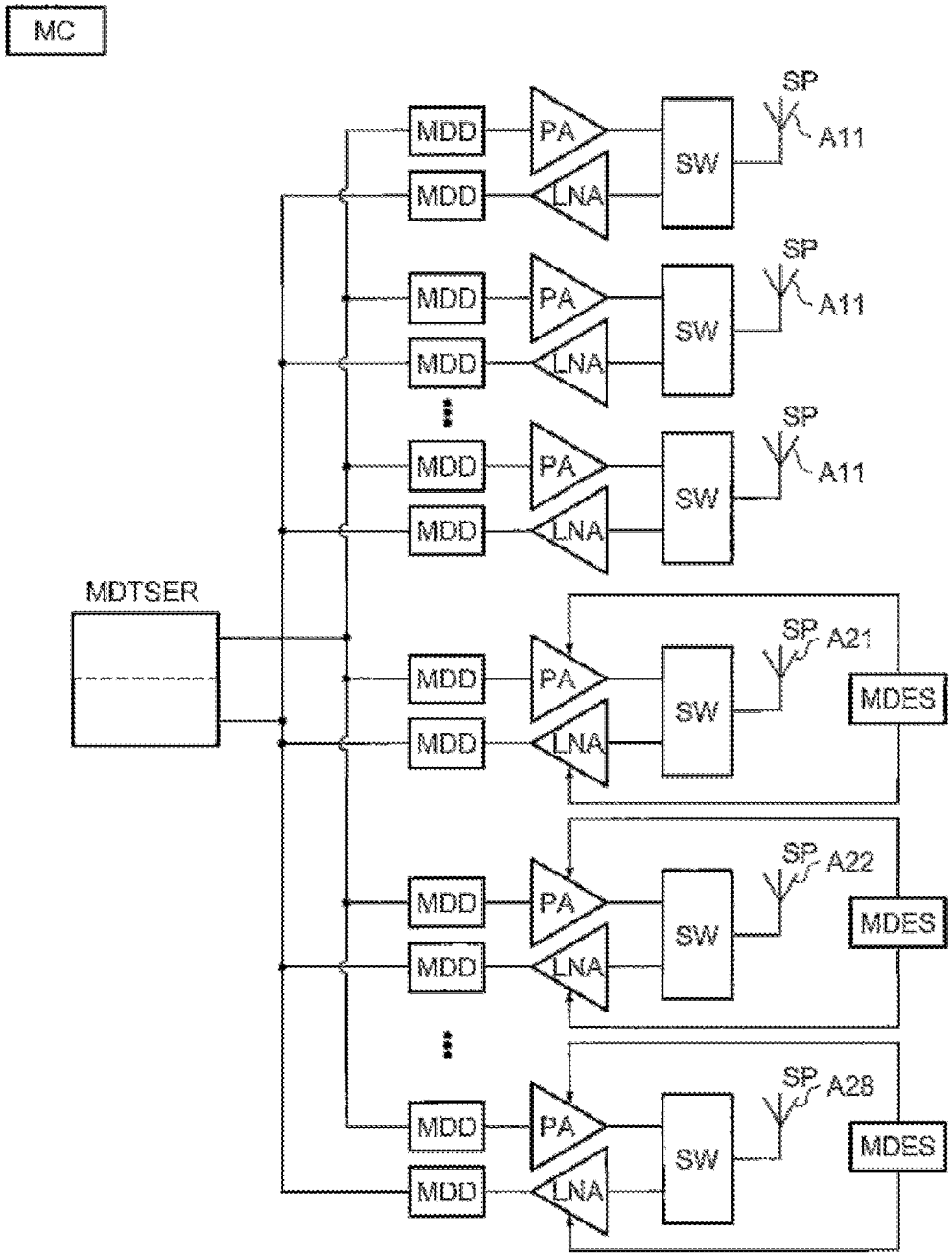
FIGS. 5 to 8 illustrate several embodiments of a transmission/reception device according to the invention.

FIG. 5 shows one embodiment of a transmission and reception device using an antenna array such as that described in FIG. 4.

Each antenna (A11 . . . A15, A21 . . . A28) is capable of transmitting and/or receiving a signal SP of microwave, millimeter or terahertz wavelength whose frequency goes from 300 MHz to 3 THz. For each antenna (A11 . . . A15, A21 . . . A28), the device DIS comprises a transmission channel and a reception channel between means for processing the signal received or transmitted MDTSER and the corresponding antenna. The means MDTSER notably comprise mixers, local oscillators, and analogue-digital and digital-analogue converters and one or more processors in baseband.

The transmission channel notably comprises, phase-shifting means MDD configured for shifting the phase of the signal to be transmitted SE and a power amplifier PA configured for amplifying the signal prior to its transmission.

The reception channel notably comprises a low-noise amplifier LNA, phase-shifting means MDD configured for applying a phase-shift to the signal following its amplification in such a manner as to obtain the received signal SR.

In this figure, a common antenna is shown for the transmission channel and the reception channel. In this case, a selector switch SW is required. However, it is also possible to provide an antenna dedicated to the transmission and another antenna dedicated to the reception.

All these means are controlled by control means MC notably capable of controlling the phase-shift applied by the means MDD to each of the signals to be transmitted or received by the antennas A11 . . . A28 in such a manner as to point electronically in a desired direction. For example, for each of the directions in which the antenna points, the various phase-shifts are fixed. According to one variant, for one pointing direction, each of the phase-shifts can vary around a fixed value.

The means MC are also capable of enabling or not each of the antennas A21 . . . A28 and the active part that supplies it via the disabling means MDES. It is indeed advantageous, for reasons of power consumption, to be able to disable a directive antenna and its active part, notably the amplifiers PA and/or LNA, which are not useful when the pointing direction is different from the maximum directivity of the radiation pattern of the directive antenna.

Figure 6:
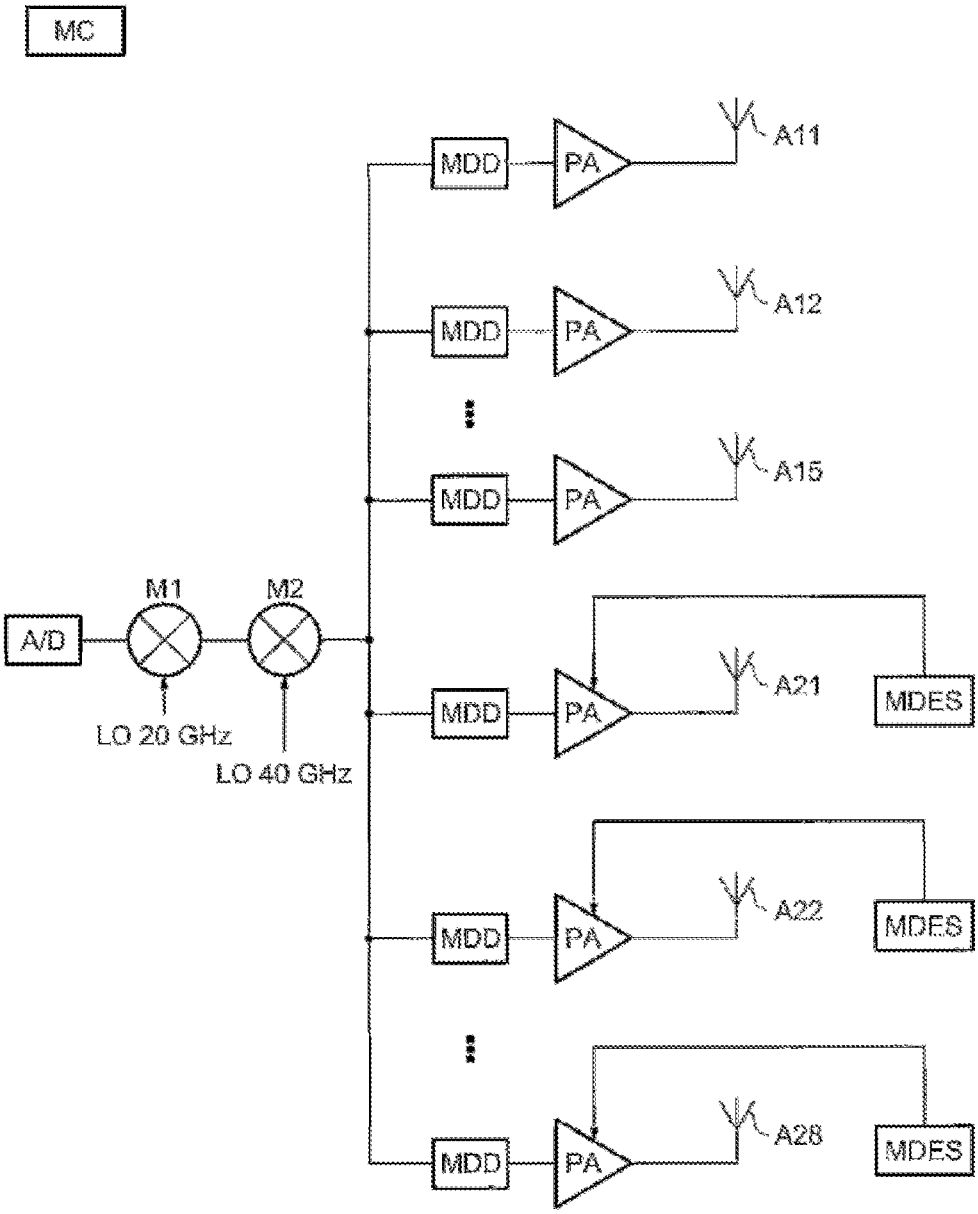
Figure 7:
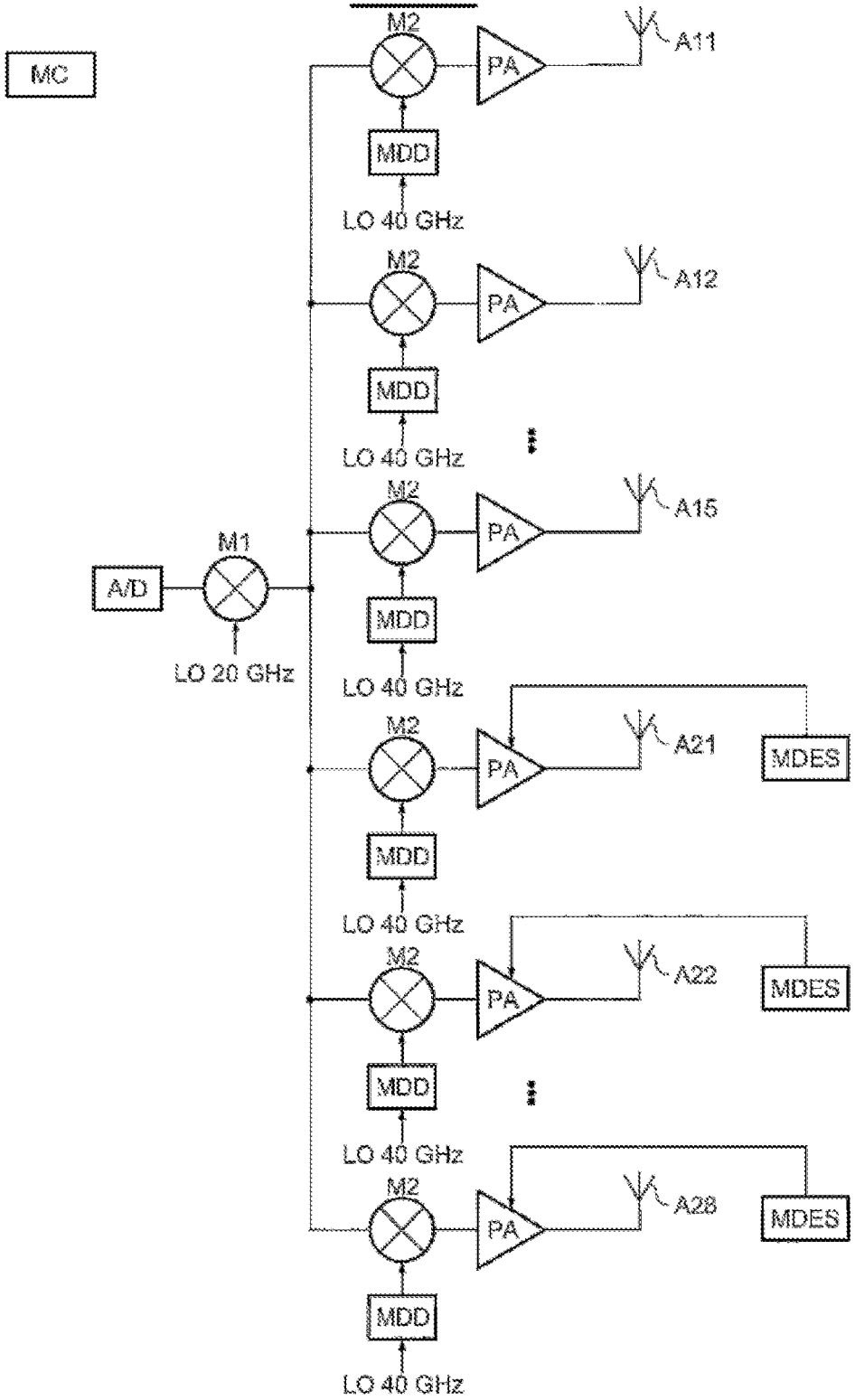
Figure 8:
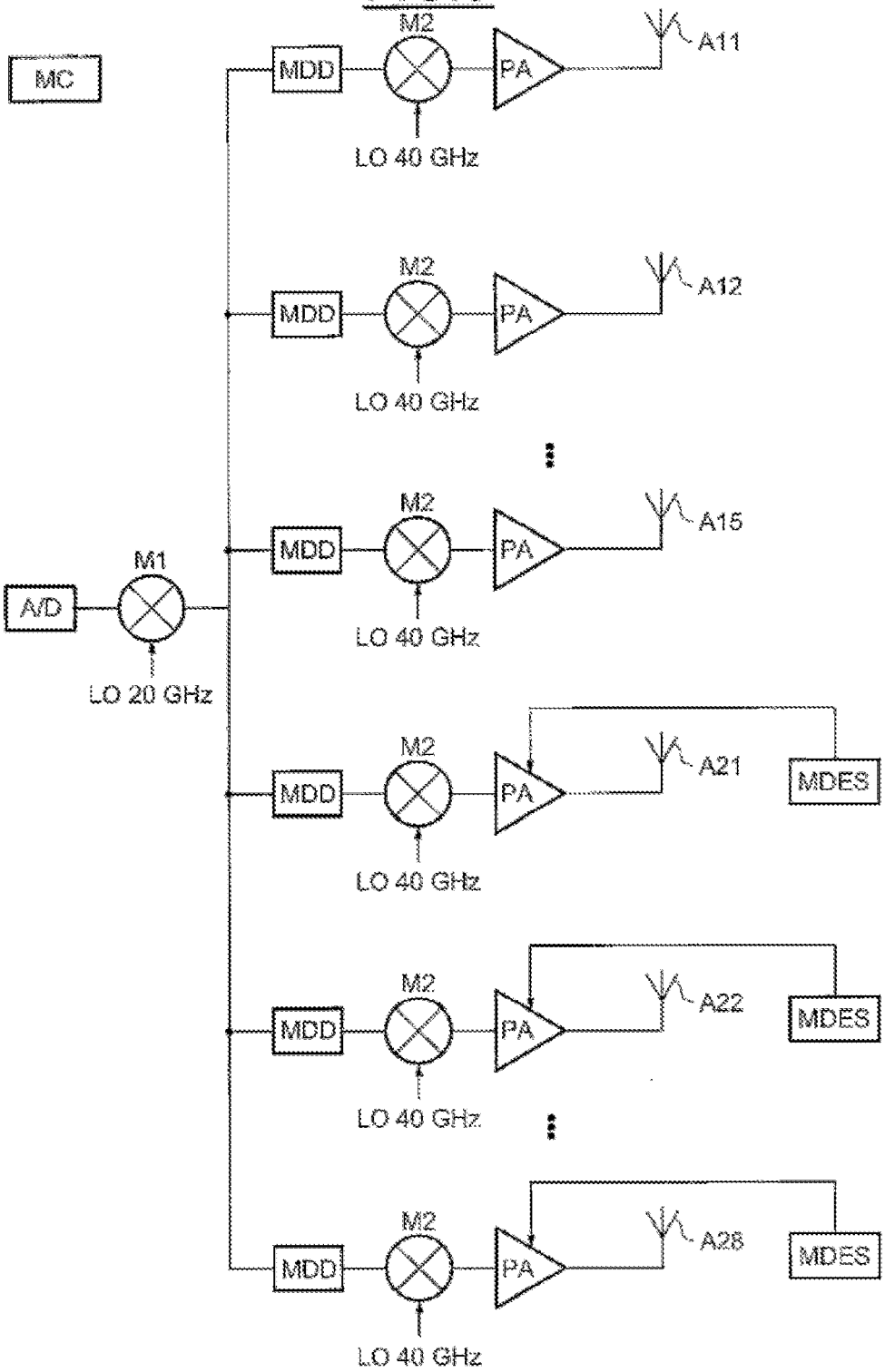

FIGS. 6 to 8 show, in more detail, a part of each transmission channel, in the case where the signal SP has a frequency of 60 GHz.

In FIG. 6, the signal in baseband undergoes a double up-frequency transposition in two mixers M1 M2 with transposition signals (local oscillator) of 20 GHz and 40 GHz. The means MDD are disposed downstream of the mixers.

In FIG. 7, the means MDD act on the second transposition signal (local oscillator at 40 GHz).

In FIG. 8, the means MDD are disposed between the two mixers M1 and M2.

It goes without saying that other variant embodiments are possible. All the means PA, LNA, MDTSER, MDD, MDES are conventional structures and known per se.

The device DIS can be integrated into a wireless communications device APP. The device APP may itself be integrated into a video and/or audio broadcasting system. For example, the device APP is advantageously integrated into a television set thus allowing the existing HDMI cables to be replaced.

What is claimed is:

1. A transmission/reception device for signals having a wavelength in the microwave, millimeter or terahertz range, the transmission/reception device comprising an antenna array, the antenna array comprising:

a plurality of first omni-directional antennas arranged as a first group in a first plane; and a plurality of second directional antennas arranged as a second group in the first plane that is disposed around the first group of antennas, wherein the plurality of first omni-directional antennas and the plurality of second directional antennas comprise a steerable antenna array.

2. The transmission/reception device according to claim 1, wherein the first group of first antennas is situated in an ovoid-shaped central region and comprises first identical antennas, whose respective isobarycentres are mutually equidistant.

3. The transmission/reception device according to claim 1, wherein isobarycentres of the respective first antennas are mutually equidistant by a distance equal to half the wavelength of the signals.

4. The transmission/reception device according to claim 1, wherein isobarycentres of the respective second antennas are mutually equidistant.

5. The transmission/reception device according to claim 1, wherein isobarycentres of the respective first and second antennas are mutually equidistant.

6. The transmission/reception device according to claim 1, wherein the first antennas of the first group all have the same orientation.

7. The transmission/reception device according to claim 1, wherein the second group of antennas is situated in a ring around a central region and comprises second identical antennas, the maximum directivity of a radiation pattern of each second antenna being oriented towards the outside of the ring with respect to the central region.

8. The transmission/reception device according to claim 7, wherein the maximum directivity of the radiation pattern of each second antenna is oriented along a radius of said ring.

9. The transmission/reception device according to claim 1, wherein an angle between the normal to each first antenna and the maximum directivity of the radiation pattern of each second antenna is in a range between 45° and 90°.

10. The transmission/reception device according to claim 1, further comprising a controller that is configured to control a disable circuit, the disable circuit configured to selectively disable at least one second antenna and its active part.

11. The transmission/reception device according to claim 10, wherein the controller is further configured to control a phase-shifter, which is configured to apply phase-shifts to the signals from the antennas of the first group and/or to the signals from the antennas of the second group.

12. The transmission/reception device according to claim 11, wherein the signals are situated in a band of frequencies around 60 GHz.

13. A method of transmitting a signal using the transmission/reception device according to claim 1, the method comprising:

transmitting a signal wirelessly using the plurality of omni-directional antennas; and simultaneously transmitting the signal wirelessly using the plurality of directional antennas that are disposed surrounding the plurality of omni-directional antennas.

14. The method of claim 13, further comprising:

phase shifting the signal prior to the transmitting steps.

15. The method of claim 14, wherein the step of phase shifting comprises applying a separate phase shift amount to the signal for each omni-directional antenna and for each directional antenna.

16. The method of claim 14 wherein the signal comprises a frequency range and wherein only a portion of the frequency range is transmitted over each respective omni-directional antenna.

17. The method of claim 16 wherein only a portion of the frequency range is transmitted over each respective directional antenna.

18. The method of claim 14, wherein the entire frequency range of the signal is transmitted over each of the omni-directional and the directional antennas.

19. The method of claim 14, further comprising amplifying the phase shifted signal prior to transmitting.

20. The method of claim 13, further comprising receiving the signal from a signal processor.

21. The method of claim 13, further comprising disabling select ones of the plurality of directional antennas.

22. The transmission/reception device according to claim 1, wherein the steerable antenna array is arranged such that a radiation pattern of the antenna array is not degraded for directions making an angle greater than 45° with a normal of the first plane.

23. A wireless communications device, comprising:

a signal processor configured to generate a first signal;

a plurality of phase shifters, each configured to receive the first signal and to shift the phase of the first signal by a predetermined shift;

a plurality of power amplifiers, each coupled to a respective phase shifter and configured to amplify a received phase shifted signal; and an antenna array including:

a plurality of omni-directional antennas, each one of the omni-directional antennas being coupled to one a respective of the plurality of power amplifiers, and a plurality of directional antennas disposed around the plurality of omni-directional of antennas, each of the directional antennas being coupled to a respective one of the plurality of power amplifiers, wherein the plurality of first omni-directional antennas and the plurality of second directional antennas comprise a steerable antenna array.

24. The wireless communications device of claim 23, further comprising:

a first plurality of low noise amplifiers, each coupled to a respective one of the omni-directional antennas; and a second plurality of low noise amplifiers, each coupled to a respective one of the directional antennas.

25. The wireless communications device of claim 24, further comprising:

a first plurality of switches, each switch having a first terminal coupled to a respective one of the plurality of power amplifiers, a second terminal coupled to respective one of the first plurality of low noise amplifiers, and a third terminal coupled to a respective one of the plurality of omni-directional antennas; and a second plurality of switches, each switch having a fourth terminal coupled to a respective one of the plurality of power amplifiers, a fifth terminal coupled to a respective one of the plurality of low noise amplifiers, and a sixth terminal coupled to a respective one of the plurality of directional antennas.

26. The wireless device of claim 23, wherein the signal is a television signal.

27. A transmission/reception device for signals having a wavelength in the microwave, millimeter or terahertz range, the transmission/reception device comprising a steerable antenna array, the steerable antenna array comprising:

a first omni-directional antenna;

a first plurality of omni-directional antennas arranged as a first group that is disposed around the first omni-directional antenna; and a second plurality of directional antennas arranged as a second group that is disposed around the first group of antennas.

* * * * *